US005193327A

United States Patent [19]

Goodenberger

[11] Patent Number: 5,193,327

[45] Date of Patent: Mar. 16, 1993

[54] PORTABLE PAVILION

[76] Inventor: Lynn F. Goodenberger, Box 149, Cambridge, Nebr. 69022

[21] Appl. No.: 749,934

[22] Filed: Aug. 26, 1991

[51] Int. Cl.[5] ..... E04B 1/00

[52] U.S. Cl. ..... 52/747; 52/79.4; 52/236.1; 52/645; 135/97; 135/100; 135/908

[58] Field of Search ..... 135/87, 95, 97, 100, 135/101, 103, 106, 900, 908; 52/63, 79.4, 79.6, 236.1, 747, 645

[56] References Cited

U.S. PATENT DOCUMENTS

| | | | |
|---|---|---|---|
| D. 191,438 | 10/1961 | Paulson | 52/79.4 X |
| 589,563 | 9/1897 | Jensen . | |
| 595,875 | 12/1897 | Ernest . | |
| 2,440,449 | 4/1948 | Raemer . | |
| 2,788,011 | 4/1957 | Turner | 135/106 |
| 2,967,534 | 1/1961 | Silye | 135/100 X |
| 3,282,001 | 11/1966 | Bigalow | 52/301 X |
| 3,952,463 | 4/1976 | Lane . | |
| 4,056,327 | 11/1977 | Daus, Jr. et al. | 135/106 X |
| 4,095,387 | 6/1978 | Loewe | 52/645 |
| 4,558,713 | 12/1985 | Hagler et al. | 135/106 |
| 4,726,153 | 2/1988 | Adler et al. . | |
| 4,739,594 | 4/1988 | Langford et al. . | |
| 4,901,928 | 3/1990 | Cellar, Jr. . | |
| 5,000,211 | 3/1991 | Speare et al. | 135/97 |

FOREIGN PATENT DOCUMENTS

| | | |
|---|---|---|
| 577240 | 6/1959 | Canada . |
| 3231396 | 5/1984 | Fed. Rep. of Germany . |

OTHER PUBLICATIONS

Gardener's Eden Mail order Ad.

*Primary Examiner*—Richard E. Chilcot, Jr.
*Assistant Examiner*—Lan M. Mai
*Attorney, Agent, or Firm*—James D. Welch

[57] ABSTRACT

A portable pavilion which is easy to assemble, break down and transport is disclosed. The portable pavilion comprises a framework and coverings. The framework is assembled from a multiplicity of each of a series of five basic standardized relatively compact elements and can be covered with canvas, clear material or screen etc. Attached serving tables and the like can also be provided. A number of portable pavilions can be assembled in close proximity to one another with open sides thereof interconnected to form a larger structure. Assembly of a portable pavilion can be facilitated by use of a removable telescoping center pole.

19 Claims, 1 Drawing Sheet

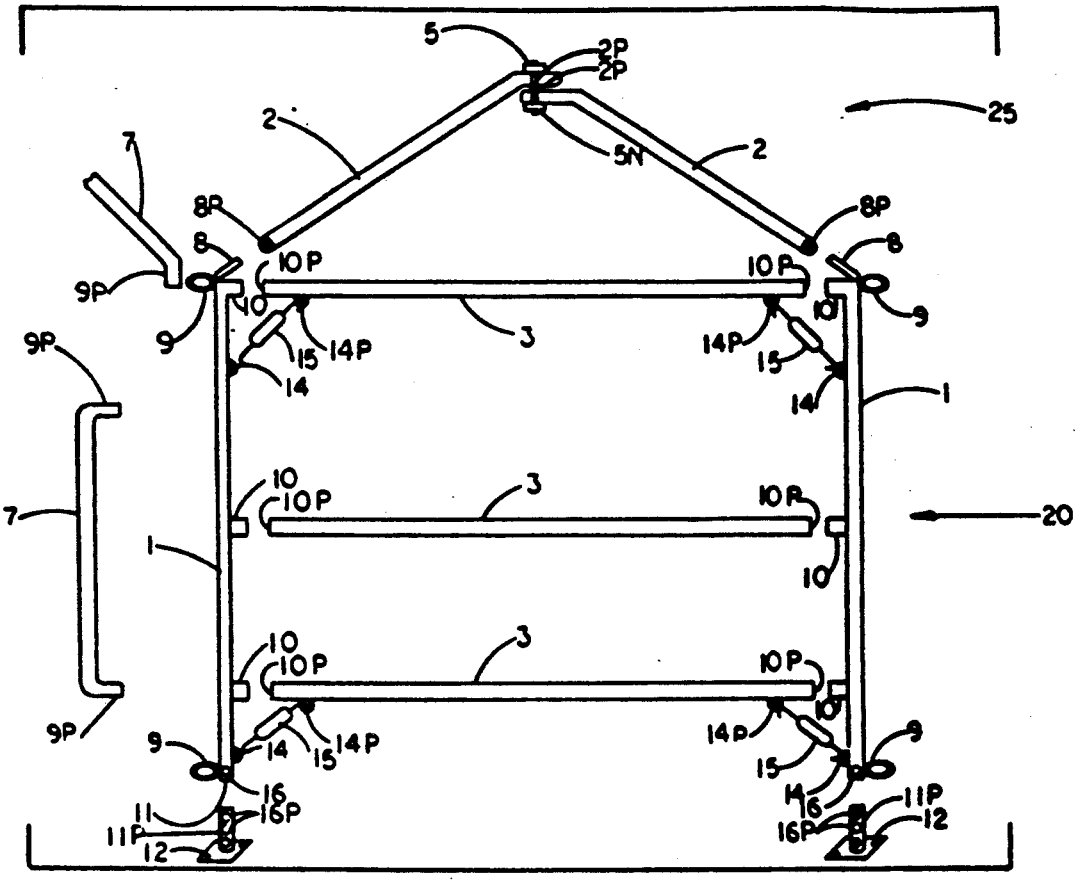
FIG. 1
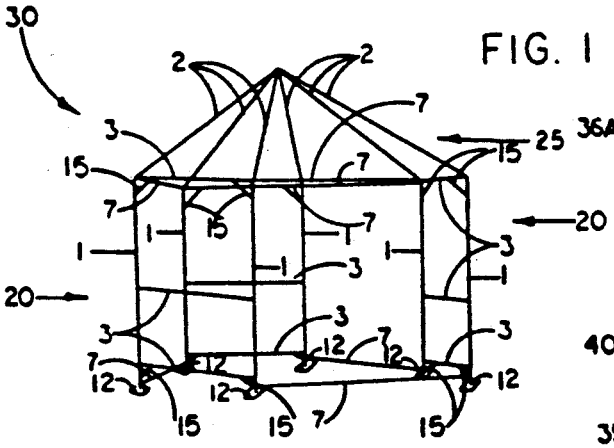
FIG. 2
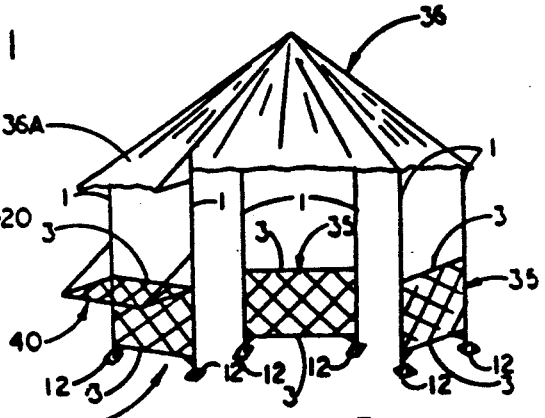
FIG. 3
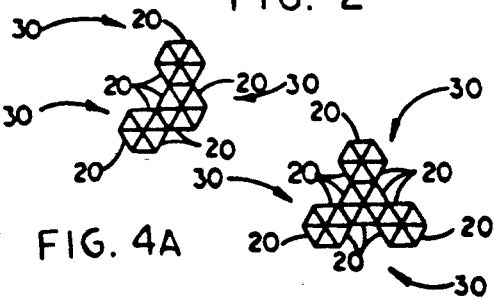
FIG. 4A
FIG. 4B
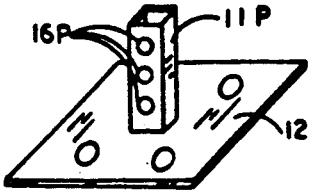
FIG. 5

PORTABLE PAVILION

TECHNICAL FIELD

The present invention relates to pavilions, and more particularly to a portable pavilion, the framework of which is comprised of a multiplicity of each of a series of five relatively compact standardized basic elements and which portable pavilion is easy to assemble, break down and transport.

BACKGROUND

The use of pavilions as ticket booths, information centers, carnival games stands, florist stands, gift shops, picnic food booths, newspaper stands and the like is well known. Such structures are often constructed by carpenters by standard techniques which result in permanent structures. Permanent construction, however, can be time consuming and costly, and in particular such structures can be difficult to move if it is later desired to do so. Portable pavilions which are relatively easy to assemble and break down, would therefore provide utility.

In recognition of this inventors have taught various structures which provide various benefits. As early as 1887 Ernest obtained U.S. Pat. No. 595,875. That Patent taught a tent or booth should be constructed such that a series of rafters are pivotally connected together at one of their ends so that the ends impinge and brace each other. A series of braces or bars forming a circuit at the other end of the rafters is also taught as present such that the series of braces or bars lap upon the rafters and are attached thereto by bolts or pins. The braces or bars are taught as selected so as to hold the point of pivotal connection of the rafters at an elevated position. The rafters are held together at their pivotal connection point by an "O" ring system, or in the alternative by a channeled element which provides separate channels into which each rafter fits. The Ernest Patent teachings provide insight as to a convenient construction for a pavilion, but seem to neglect to teach a system which reduces the number of components required to assemble a pavilion to a minimum, and which facilitates easy assembly, breaking down and transport.

A Patent to Raemer, U.S. Pat. No. 2,440,449 teaches a demountable building structure with a plurality of upright walls of a predetermined width which are arranged in desired angular relation and with edge abutment one to the other. Said upright walls are held in place by upper and lower edge headers. Said upper and lower edge headers are each, in length, the equivalent of the width of one upright wall plus a portion of the abutting walls on either side thereof. While the Raemer invention might provide some convenience in assembly and breaking down thereof, the presence of relatively large area upright walls can present a problem in transport. Another U.S. Pat. No. 4,910,928 to Cellar, Jr. also teaches the use of a plurality of wall panels and the use of upper and lower securing means in conjunction with means for releasably connecting the side edges of one wall panel to the side edges of the abutting wall panels on either side thereof. Again transport of relatively large area wall panels can be a problem.

A Patent to Langford et al., U.S. Pat. No. 4,739,594 teaches a gazebo structure which does not include relatively large area walls, but which does require a plurality of pie-shaped roof sections, each of which has first and second elongated side beams positioned at first and second sides portions thereof. Said roof sections can be difficult to transport.

In view of the above sampling of Patents it can be concluded that inventors have recognized the utility which can result from pavilion design which allows easy assembly, brake down and transport. A study of the identified patents also shows that pavilions generally have a similar outer appearance, and that what is new and novel in the various teachings therein is the construction of the Claimed Pavilions. It follows that a portable pavilion design which provides alternate construction which further enhances desirable attributes, (eg. ease of assembly, breakdown and transport), would be of benefit and provide utility.

DISCLOSURE OF THE INVENTION

The present invention provides an easy to assemble Pavilion, the framework of which is comprised of a multiplicity of each of a series of five relatively compact basic standardized elements. The Pavilion can be configured as desired by a user thereof during an assembly process.

The five relatively compact basic standardized elements of the frame of the present invention are:

side supports;
side spacers;
side support feet;
roof supports; and
side structure interconnection elements.

The side supports are elongated elements and have placed along their longitudinal dimension a multiplicity of connection means. At one end thereof is a connection means for attaching a side support foot thereto, and at the opposite end thereof is a connection means for attaching one end of a roof support thereto. Typically, at both ends thereof, but at least at the end at which is located the roof support connection means is (are) connection means for attaching one end of a side structure interconnection element thereto. Also present at the end at which is located the roof support connection means, and at intermediate points between the ends of the side supports are connection means for attaching side spaces thereto. The side spacers are also elongated structures with connection means on the ends thereof which are complimentary to the side spacer connection means present on the side supports. The roof supports are elongated structures which have at one end thereof connection means which are complimentary to the roof support connections means present on the side supports, and which have, at the opposite end thereof connection means for interconnecting similar ends of a multiplicity of roof supports. The side structure interconnecting elements are again elongated and have at both ends similar connection means which are complimentary to side structure interconnection element connection means present on the side supports. The side support feet are typically flat relatively large surface area structures with typically centrally located connection means on one flat surface thereof, which connection means are complimentary to side support feet connection means present on the side supports. Present on each side foot connection means which is complimentary to side foot connection means are means which allow attachment between a side support and a side support foot in more than one relative orientation. This allows adjustment when, for instance, a portable pavilion is assembled upon an underlying surface which deviates from essentially horizontal. Said side support feet might also have stake holes therethrough or stake-like projections present on the flat relatively large area surface opposite the flat relatively large area surface upon which the side support connection means are present, for use in securing same to an underlying, typically essentially horizontal, surface upon which the present invention might be erected.

To better disclose the present invention the assembly process for a hexagonal shaped Pavilion will be described. A six sided Pavilion is used as an example, and is not to be interpreted as a limitation of the present invention. In what follows it is assumed that the Pavilion is being assembled upon an underlying essentially horizontal surface.

The first step in the assembly process comprises placing support feet onto six side supports by way of previously mentioned connection means. Said combinations of elements are then each then placed such that a flat relatively large surface area of each side support foot, which is on the side thereof opposite to that upon which is the complimentary side support connection means, rests upon the underlying essentially horizontal surface, and so that the longitudinal dimension of each of the side supports projects vertically, perpendicular to said underlying essentially horizontal surface. Said combinations of elements are then paired and placed, with respect to one another, such that the side spacer connection means on one member of each said pair faces the side spacer connection means on the other member thereof. Side spacers are then placed between each pair of side supports and side supports feet element combinations, and attached therebetween, by way of previously mentioned side spacer connection and complimentary side spacer connection means. This forms three "side structures", each of which have a generally rectangular shape, (square and six (6) foot on a side in the preferred embodiment), when viewed in side elevation from a distance perpendicularly removed from a longitudinal dimension of a side spacer element therein.

Said side structures are then positioned with respect to one another in a manner which is best described as tangential to one of an infinite number of possible circle circumferences, which circle circumference is centered at a point determined by extending projections from each side structure to a central meeting point, which projections are simultaneously perpendicular to the longitudinal dimensions of the side spacers as they appear in side elevation in the generally rectangular shape of each side structure, and parallel to the underlying essentially horizontal surface. The distance between the side supports of one side structure and the side supports of the adjacent side structures to each side thereof, is determined by the length of the side structure interconnection elements which attach to the side structure interconnection element connection means on said "adjacent" side supports, which side structure interconnection elements are in fact caused to interconnect adjacent side supports by way of side structure interconnection element connection means on said adjacent side supports, typically at vertically upper and lower ends of the side supports. (Note that the word "adjacent" as used herein, does not imply that the side supports of two side structures interconnected by a side structure interconnection element contact one another. Also note that the specific circle circumference to which the generally rectangular shape of each side structure is tangential is determined by the lengths of the side spacers and side structure interconnecting elements, which lengths might or might not be equal).

Continuing, six roof supports are next, at one end of each, pivotally interconnected by way of previously mentioned connection means, and are caused to be positioned so that the longitudinal dimension of each projects outwardly from their interconnection point, and in an angularly offset direction, (as viewed from above), with respect to each other said roof support. Said configured "roof support structure" is then lifted so that complimentary side support connection means on the projected ends of each roof support element meet, and attach to, roof support connection means present on each side support. Typically the ends of the various roof supports which are interconnected will not be firmly secured to one another until after the projected ends thereof are attached to the roof support connection means on the various side supports. This approach allows easy adjustment of the angular offset between the various roof supports necessary to bring the complimentary connection means on said projected ends of the roof supports, and the roof support connection means on the side supports into alignment during the Pavilion assembly process. It is also mentioned that during the procedure by which all roof supports are attached to their respective side supports, a temporary telescoping center support pole might be used to support the roof supports at their central point of interconnection. Means for securing said roof support interconnection point might also be present in said temporary telescoping center support pole so that prior to removal thereof said interconnection can be easily secured by use thereof.

It is also mentioned that the roof supports are typically caused, by the shape thereof, to project vertically downward as well as outward from their interconnection point to their attachment points with the various side supports, to form a sloping roof frame.

Further steps in the assembly of the present Pavilion might include adjusting the attachment between one or more side supports and associated side support feet, removing the lower located side structure interconnection elements and affixing a covering to the side structures vertically between locations on the side spacers therein and covering the roof support structure with canvas or some other material. It is also within the scope of the present invention to cover the entire Pavilion framework with canvas or a clear material or perhaps screen. In addition, horizontally projecting surfaces might be attached to side spacers in the side structures for use as serving or display means. Above said horizontally projecting serving or display surfaces might also be fashioned awnings by projection from the upper most side spacer in the side structure. The awnings can be extensions of a roof support structure covering.

It will be appreciated that the present invention provides alternating side structures and open sides, at the upper aspects of which open sides are present the side structure interconnection elements. A multiplicity of portable pavilions can be interconnected at open sides thereof to form a larger structure.

It should also be appreciated that the present invention provides a design for a portable pavilion which allows easy assembly, breaking down and transport of the relatively compact framework and other elements thereof.

The present invention will be better understood by reference to the Detailed Description Section and the accompanying Drawings.

BRIEF DESCRIPTION OF THE DRAWINGS

FIG. 1 shows an exploded view of the relatively compact basic standardized elements of the framework of the present invention positioned to show how assembly of the portable pavilion is accomplished.

FIG. 2 shows an assembled portable pavilion framework.

FIG. 3 shows an assembled portable pavilion framework with various coverings thereon, and with a serving table or display means shown attached to a side spacer thereof.

FIG. 4 shows, in a view from atop thereof, a series of portable pavilions which have been assembled in close proximity to one another so that open sides thereof are interconnected to form a larger structure.

FIG. 5 shows an expanded view of a side support foot.

DETAILED DESCRIPTION

Turning now to the Drawings, there is shown, in FIG. 2, an assembled portable pavilion framework for a hexagonal structure (30). Note that side structures (20) alternate with open spaces as one circles said assembly. To understand how said framework is assembled it is best to refer to FIG. 1 in which an exploded view of one side structure (20), with roof supports (2) of a roof support structure (25) also shown. In particular, two side supports (1) are shown oriented with their longitudinal dimensions projected vertically. At the vertically lower ends thereof are shown side support feet (12) with connection means (11P) thereon which are complimentary to side support feet connection means (11) on side supports (1). Note that on complimentary connection means (11P) are located more than one connection point means shown as holes (16P). Pins can extend therethrough, and through holes (16) in the side supports (1) to adjust the Interconnection relational orientation between a side support (1) and its associated side support foot (12). In the preferred embodiment the side feet complimentary connection means (11P) and side support feet connection means (11) are square in shape when viewed in cross section from a point vertically above the side support feet, with connection means (11P) being a projection, and connection means (11) being a hole. Also shown are side spacers (3) with connection means (10P) therein which are complimentary to side spacer connection means (10) on side supports (1). Note also that eyelet connection means (14) and (14P) are present on the side supports (1) and side spacers (3) respectively to allow turnbuckles (15) to secure side spacers (3) to side supports (1). Typically only the vertically uppermost and lowermost side spacers (3) are secured to side supports (1) at connection means (14) and (14P) by turnbuckles (15), or by other connection means. Said turnbuckles (151 can be permanently affixed to either of the identified interconnected elements to prevent loss thereof. Present on side supports (1) at the vertically upper ends thereof are roof support connection means 8) and side structure interconnection element connection means (9).

It is to be understood that when side support feet (12) are attached to side supports (1) and two said side supports (1) with side support feet (12) attached thereto are interconnected by side spacers (3) a side structure (20) results.

Also shown in FIG. 1 are roof supports (2) with connection means (8P) present thereon at one end thereof. Said roof support connection means (8P) are typically rods which are attached to and project at an angle to the longitudinal axis of their associated side supports (1) and are complimentary to roof support connection means (8) present on sides supports (1). Said roof support connection means (8P) are typically holes which project longitudinally into the roof supports. Roof supports (2) also have interconnection means (2P), typically holes therethrough perpendicular to the longitudinal axis of the roof supports (2), present at the opposite end thereof to allow interconnection of a multiplicity of roof supports, by way of roof support interconnection connection demonstrated as a bolt (5) and a nut (5N).

Also shown in FIG. 1 is a side structure interconnection element (7) with connection means (9P) thereon which are complimentary to side structure rod interconnection element connection means (9) on side supports (1). Note that a second side structure interconnection element might be placed at the lower end of the side supports into additional side structure interconnection element connection means (9). During assembly of a portable pavilion this can help orient the side structures (20) properly. During use, however, it is typical to remove a lower placed side structure interconnection element (7) after side feet (12) are in place and staked to the underlying essentially horizontal surface.

FIG. 2 indicates how three side structures (20) are positioned with respect to one another when a six sided portable pavilion structure is to be assembled. FIG. 2 also shows a roof support structure (25) attached to the three side structures (20) which are interconnected by six side structure interconnection elements (7). Note that in FIG. 3, a fully assembled portable pavilion is shown and has lower side structure interconnection elements (7) removed to allow easy entry and exit thereto.

It is mentioned that side spacer connection means (10) and complimentary side spacer connection means (10P) can be simple projecting rods and hollow pipes which slide thereover, which can then be secured in place by pins which project through holes therein, much as shown with respect to the side support feet, (see holes (16) and (16P) in FIG. 1 and holes (16P) in FIG. 5), or by turnbuckles (15). Side structure interconnection element connection means (9) is typically an eye into which the side structure interconnection element complimentary connection means (9P), (typically a rod structure), on side structure interconnection elements (7) slide. Again a pin can be used to secure such by way of holes therethrough, but this is not typically necessary. Roof support connection means (8) on side supports (1) are typically angularly oriented rods as shown in FIG. 1 and complimentary roof support connection means (8P) on roof supports (2) are typically hollow pipes which slide over said roof support connection means rods (8). Roof support interconnection means (2P) are typically simply holes through which holes a bolt (5) can insert, and be secured in place by a nut (5N).

The assembly process of the present invention is described in the Invention Disclosure Section herein. It is again mentioned, however, that assembly can be facilitated by use of a telescoping pole which has at one end thereof a means for releasably attaching to the roof support interconnection means demonstrated as a nut (5N) in FIG. 1. Said telescoping pole can be used to lift the assembled roof support structure (25) to a vertical level which allows easy attachment of complimentary roof support connection means (8P) and roof support connection means (8) at each side support (1). After all such attachments are completed the telescoping pole can be used to secure the roof support interconnection connection means, such as by rotating nut (5N). Said telescoping pole can then be removed. In addition, if side structure interconnection elements (7) are utilized at the lower end of the side supports (1) to aid with side structure (20) orientation during assembly, they are typically removed prior to use of the assembled portable pavilion.

It is also mentioned that holes can be present in the side support feet to allow staking to the underlying essentially horizontal surface. This will secure the assembled portable pavilion during use thereof. In the alternative, projecting spikes might be fabricated into the underside of the side support feet to perform a similar function.

FIG. 3 shows a portable pavilion framework with a covering (36) over the assembled roof support structure (25). Said covering can be canvas, a clear material or screen etc. Also shown is a lattice work (35) secured vertically between two side spacers (3) which are located in the lower vertical half of the vertically projecting side supports of each side structure. Said lattice work (35) can also be a chalk board or a fabric etc. It is also possible to cover the entire portable pavilion with a canvas, clear material, screen, lattice work etc.

FIG. 3 also shows that a serving table (40) can be attached to a side spacer (3) and that the covering (36) over the roof structure (25) can be extended thereover to form an awning (36A).

FIGS. 4*a* and 4*b* show, in a view from atop thereof, that a number of portable pavilions can be assembled in close proximity to one another so that open sides thereof are interconnected, to form a larger structure.

Finally, while not shown in the Drawings, it should be readily obvious that the system of the present invention can be equally applied to Portable Pavilions with four, six, eight etc. sides with the same ease of assembly demonstrated for a six sided Portable Pavilion herein.

Having hereby disclosed the subject matter of the present invention, it should be obvious that many modifications, substitutions and variations of the present invention are possible in light of the teachings. It is therefore to be understood that the present invention may be practiced other than as specifically described, and should be limited in breadth and scope only by the claims.

I claim:

1. A method of assembling a portable pavilion;

said portable pavilion being easy to assemble, break down and transport, said portable pavilion being comprised of a framework, which framework is comprised of a multiplicity of each of a series of standardized relatively compact basic elements including:

side supports;

side spacers;

side support feet;

roof supports; and side support interconnection elements;

the number of said side supports, side feet and rood supports being equal;

said side supports being elongated elements with a multiplicity of side spacer connection means thereon for connecting to said side spaces; on one end of each said side support there being a side support foot connection means for connecting to a complimentary connection means on a side support foot; and on the other end of each support there being a roof support connection means typically projecting at an angle to the longitudinal axis of said side support; said side supports further having eyelet element connection means at the ends thereof to allow interconnecting of adjacent side supports by side support interconnection elements;

said side spacers being elongated elements, with connection means in the longitudinally opposed ends thereof which are complimentary to the side spacer connection means on the side supports;

said roof supports being elongated elements with connection means on one end thereof which are complimentary to roof support connection means on one end of said side support, and which have means for pivotally interconnecting a multiplicity of said roof supports, at the longitudinally opposed end thereof, to one another to form a roof structure;

said side support feet being essentially flat relatively large surface area structures with a complimentary connection means on one relatively large surface area side thereof allowing connection to a side support foot connection means on one end of each side support, each of said side support feet being connected to a side support in one of a number of possible orientations;

said multiplicity of side supports being paired off and oriented with each side support projecting essentially vertically from its connection to its associated side support foot as said side support foot sets upon an essentially horizontal underlying surface, and with the side spacer connection means of one side support in each pair facing the side spacer connection means of the second side support thereof, between corresponding side spacer connection means there being connected side spacers; said upper and lower side spacers secured to the side supports to which they are connected by turnbuckles or equivalent, to form a side structure;

a multiplicity of which side structures are oriented with respect to one another in a fashion best described as tangential to a circumference of a circle which has its center at a point whereat projections which are simultaneously perpendicular to the longitudinal dimension of the side spacers in each side structure, and parallel to the underlying essentially horizontal surface, meet; and which projections are angularly offset with respect to one another as viewed from above said multiplicity of side structures;

adjacent side structures being interconnected by at least one side structure interconnection element which connects to side structure eyelet element connection means present on each side support;

said roof structure being connected to the interconnected side structures at each side support by connection means on each roof support which are complimentary to the roof support connection means on the side supports;

which method comprises the steps of:

a. assembling the side structures and interconnecting them, with side structure interconnection elements, at upper and lower ends thereof;

b. assembling the roof structure;

c. releasably attaching a telescoping center pole to the means for pivotally interconnecting the multiplicity of roof supports and lifting the roof structure vertically to a level which allows connection of each roof support to a side support;

d. operating the telescoping center pole so that the roof support interconnecting means are secured; and e. removing the telescoping center pole and the lower side structure interconnecting elements.

2. A portable pavilion which is easy to assemble, break down and transport, which portable pavilion is comprised of a framework, which framework is comprised of a multiplicity of each of a series of standardized relatively compact basic elements including:

side supports;

side spacers;

side support feet;

roof supports; and side support interconnection elements;

the number of said side supports, side feet and roof supports being equal;

said side supports being elongated elements with a multiplicity of side spacer connection means thereon for connecting to said side spacers; on one end of each said side support there being a side support foot connection means for connecting to a complimentary connection means on a side support foot; and on the other end of each side support there being a roof support connection means typically projecting at an angle to the longitudinal axis of said side support; said side supports further having eyelet element connection means at the ends thereof to allow interconnecting of adjacent side support by side support interconnection elements;

said side spacers being elongated elements, with connection means in the longitudinally opposed ends thereof which are complimentary to the side spacer connection means on the sides supports;

said roof supports being elongated elements with connection means on one end thereof which are complimentary to roof support connection means on one end of each side support, and which have means for pivotally interconnecting a multiplicity of said roof supports, at the longitudinally opposed end thereof, to one another to form a roof structure;

said side support feet being essentially flat relatively large surface area structures with a complimentary connection means on one relatively large surface area side thereof allowing connection to a side support foot connection means on one end of each side support, each of said side support feet being connected to a side support, in one of a number of possible orientations;

said multiplicity of side supports being paired off and oriented with each side support projecting essentially vertically from its connection to its associated side support foot as said side support foot sets upon an underlying essentially horizontal surface, and with the side spacer connection means of one side support in each pair facing the side spacer connection means of the second side support thereof, between corresponding side spacer connection means there being connected side spacers; with upper and lower side spacers secured to the side supports to which they are connected by turnbuckles or equivalent, to form a side structure;

a multiplicity of said side structures are oriented with respect to one another in a fashion best described as tangential to a circumference of a circle said has its center at a point whereat projections which are simultaneously perpendicular to the longitudinal dimension of the side spacers in each side structure, and parallel to the underlying essentially horizontal surface, meet; and which projections are angularly offset with respect to one another as viewed from above said multiplicity of side structures;

adjacent side structures being interconnected by at least one side structure interconnection element which connects to side structure eyelet element connection means present on each side support;

said roof structure being connected to the interconnected side structures at each side support by connection means on each roof support which are complimentary to the roof support connection means on the side supports.

3. A portable pavilion, as in claim 2, in which the number of side supports is six.

4. A portable pavilion, as in claim 2, in which the number of side supports is other than six.

5. A portable pavilion, as in claim 2, in which the number of side spacers is three per side structure, with one said side spacer being located at the vertically upper end of the sides supports, and with two side spacers being located at positions intermediate to the vertically upper and lower ends of said side supports.

6. A portable pavilion, as in claim 5, which further comprises a side spacer located at the vertically lower end of the side supports.

7. A portable pavilion, as in claim 5, in which the two side spacers which are located intermediate to the vertically upper and lower ends of the side supports are within the vertically lower half of the side supports, and between which two intermediately located side spacers is placed a covering.

8. A portable pavilion, as in claim 7, in which the covering is a lattice work.

9. A portable pavilion, as in claim 7, in which the covering is a chalk board.

10. A portable pavilion, as in claim 7, in which the covering is a fabric.

11. A portable pavilion, as in claim 2, in which the roof structure is covered with a canvas material.

12. A portable pavilion, as in claim 2, in which the roof structure is covered with a clear material.

13. A portable pavilion, as in claim 2, in which the roof structure is covered with a screen material.

14. A portable pavilion, as in claim 2, in which the side structures are covered with a canvas material.

15. A portable pavilion, as in claim 2, in which the side structures are covered with a clear material.

16. A portable pavilion, as in claim 2, in which the side structures are covered with a screen material.

17. A portable pavilion, as in claim 1, which further comprises a serving table which attaches to a side spacer.

18. A structure formed from a number of portable pavilions, which portable pavilions are described in claim 2, and which number of portable pavilions are assembled in close proximity to one another such that open sides thereof, at the vertically upper aspects of which open sides are present side structure interconnection elements, are coincident.

19. A portable pavilion as in claim 2, in which the side support feet have holes therethrough which are perpendicular to the planes of the relatively large surface area sides thereof, through which holes stakes can be placed, and/or which side support feet have projections on the relatively large surface area side thereof which is opposite to that upon which is present the complimentary connection means which allow connection to side support foot connection means present on one end of each side support, which stakes and/or projections serve, during use, to secure said side support feet to the underlying essentially horizontal surface by projecting thereinto.

* * * * *